US012078177B2

(12) United States Patent
Olsson et al.

(10) Patent No.: US 12,078,177 B2
(45) Date of Patent: Sep. 3, 2024

(54) SUBMERSIBLE ELECTRIC MACHINE

(71) Applicant: Xylem Europe GmbH, Schaffhausen (CH)

(72) Inventors: Staffan Olsson, Bromma (SE); Måns Bergsten, Stockholm (SE); Gert Hallgren, Hägersten (SE)

(73) Assignee: Xylem Europe GmbH, Schaffhausen (CH)

( * ) Notice: Subject to any disclaimer, the term of this patent is extended or adjusted under 35 U.S.C. 154(b) by 37 days.

(21) Appl. No.: 17/040,621

(22) PCT Filed: Mar. 22, 2019

(86) PCT No.: PCT/EP2019/057211
§ 371 (c)(1),
(2) Date: Sep. 23, 2020

(87) PCT Pub. No.: WO2019/185469
PCT Pub. Date: Oct. 3, 2019

(65) Prior Publication Data

US 2021/0115927 A1 Apr. 22, 2021

(30) Foreign Application Priority Data

Mar. 26, 2018 (EP) ..... 18163865

(51) Int. Cl.
*F04D 13/08* (2006.01)
*F04D 13/06* (2006.01)
(Continued)

(52) U.S. Cl.
CPC ..... *F04D 13/08* (2013.01); *F04D 13/0686* (2013.01); *F04D 15/00* (2013.01); *F04D 15/0088* (2013.01); *F04D 29/18* (2013.01)

(58) Field of Classification Search
CPC ..... F04D 29/18; F04D 15/0088; F04D 13/08; F04D 13/0686; F04D 15/00; F04D 13/086
See application file for complete search history.

(56) References Cited

U.S. PATENT DOCUMENTS 3,746,472 A * 7/1973 Rupp ..... H02K 5/132 277/358
6,205,872 B1 3/2001 Pflueg
(Continued)

FOREIGN PATENT DOCUMENTS

DE 19963608 A1 7/2000
DE 102009005154 A1 7/2010
(Continued)

OTHER PUBLICATIONS

ANSI/HI 9.6.4—2009 (Year: 2009).*
(Continued)

*Primary Examiner* — Philip E Stimpert
(74) *Attorney, Agent, or Firm* — Buchanan Ingersoll & Rooney PC

(57) ABSTRACT

A submersible electric machine for transporting a liquid, the machine having a hydraulic unit with an impeller, and a drive unit with a housing defining a motor compartment having an electric motor inside. A drive shaft is connected to the electric motor, and extends from the electric motor to the hydraulic unit to a connection with the impeller. A top unit includes a housing defining an electronics chamber separated from the motor compartment by a dividing structural wall. The electronics chamber has a metal partition, having a natural frequency equal to or more than 500 Hz, connected to the top unit housing. A vibration sensor is directly or
(Continued)

indirectly connected to the metal partition and monitors vibrations in at least two dimensions at frequencies ranging up to 500 Hz.

19 Claims, 3 Drawing Sheets

(51) Int. Cl.
*F04D 15/00* (2006.01)
*F04D 29/18* (2006.01)

(56) References Cited

U.S. PATENT DOCUMENTS

| | | | | |
|---|---|---|---|---|
| 2013/0026866 | A1 | 1/2013 | Morisaki et al. | |
| 2015/0159657 | A1* | 6/2015 | Roussel | F04D 27/004 417/19 |
| 2015/0308244 | A1* | 10/2015 | Cardamone | G05B 15/02 700/282 |
| 2017/0328199 | A1 | 11/2017 | Marsh | |

FOREIGN PATENT DOCUMENTS

| | | | | |
|---|---|---|---|---|
| EP | 2426360 | A2 * | 3/2012 | F04D 13/08 |
| KR | 101007565 | B1 | 1/2011 | |
| KR | 101578478 | B * | 12/2015 | F04D 13/086 |
| KR | 101578478 | B1 | 12/2015 | |
| WO | 2018042626 | A1 | 3/2018 | |

OTHER PUBLICATIONS

Low-Cost Vibration Sensors: Tendencies and Applications in Condition Monitoring of Machines and Structures, Fabio Roberto De Carvalho Alves (Year: 2015).*
Accelerometers, Wikipedia (Year: 2018).*
International Search Report and Written Opinion for International Application No. PCT/EP2019/057211, dated May 28, 2019, 8 pages.
Notice of Opposition to European Patent No. 3546760, Application No. 18163865.1, dated Mar. 26, 2018, 41 pages.
American National Standard for Rotodynamic Pumps for Vibration Measurements and Allowable Values, dated May 13, 2009, 37 pages.
International Standard ISO 10816-7:2009(E), "Mechanical Vibration—Evaluation of Machine Vibration by Measurements on Non-Rotating Parts", 2009, 22 pages.
"Low-Cost Vibration Sensors: Tendencies and Applications in Condition Monitoring of Machines and Structures", Dec. 2015, with translation, 116 pages (with translation).
Wikipedia.com, Accelerometer, downloaded from https://en.wikipedia.org/w/index.php?title=Accelerometer&oldid=830489745, Apr. 13, 2021, 11 pages.
Wikipedia.com, "Submersible pump", downloaded from https://en.wikipedia.org/w/index.php?title=Submersible_pump&okfid=622772546, Apr. 20, 2021, 4 pages.
Wikipedia.com, "Insulator (electricity)", downloaded from https://en.wikipedia.org/w/index.php?title=insulator_(electricity)&oldid=830114793, dated Apr. 20, 2021, 9 pages.
Wikipedia.com, "Aluminium" of Mar. 15, 2018, 35 pages, dowloaded from https://de.wikipediaorg/w/index.php?title=aluminium&oldid=175028606.
Wikipedia.com, "Diffuser" of Jun. 28, 2017, 5 pages, downloaded from https://de.wikipedia.org/w/index.php?title=Diffusor&oldid=166807752.
"Was ist ein Beschieunigungssensor?" of Mar. 25, 2018, 3 pages, downloaded from https://www.omega.de/prodinfo/beschieunigungsmesser-vibrationsaufnehmer.html.
"Optimale Montage von Vibrationsaufnehmern", of Oct. 6, 2009, 4 pages.
"Akustische Eigenschaften" (Lexikon der Kunststoffprufung) of Oct. 12, 2015, 2 pages, downloaded from https://web.archive.org/web/20151012043629/http://wiki.polymerservice-merseburg .de/index php/Akustische _Eigenschaften.
"Auswaht industrieller Vibrationssensoren leicht gemachti" of Aug. 8, 2013, 4 pages.
Wibbeler, J., "Frequenzselektive Vibrationssensoren mit Spannungsgesteuerter Resonanzabstimmung in Oberflächenmikromechanik", Dissertation, Oct. 27, 2003, 166 pages.
"Mechanical Vibration of Rotating and Reciprocating Machinery—Requirements for Instruments for Measuring Vibration Severity", Deutsche Norm, DIN ISO 2954 Oct. 2012, 18 pages.
Bruel & Kjaer, "Handbook Structural Testing", 1988, 49 pages.
Bruel & Kjaer, "Handbook Measuring Vibration", 1982, 42 pages.
Bruel & Kjaer, Enzyklopadie, "Absolutdruckaufnehmer;Seismische Aufnehmer", 2016, 1 page.
Grounds for Appeal for European Patent No. 3546760, dated Dec. 6, 2022, 70 pages.
European Decision Rejecting the Opposition of EP Patent No. 3546760, dated Jul. 28, 2022, 22 pages.

* cited by examiner

SUBMERSIBLE ELECTRIC MACHINE

CROSS-REFERENCE TO RELATED APPLICATIONS

This patent application is a U.S. National Phase Patent Application of PCT Application No.: PCT/EP2019/057211, filed Mar. 22, 2019, which claims priority to European Patent Application No. 18163865.1, filed Mar. 26, 2018, each of which is incorporated by reference herein in its entirety.

TECHNICAL FIELD OF THE INVENTION

The present invention relates generally to the field of submersible electric machines especially configured for transporting/handling a liquid, preferably liquid comprising solid matter. Thus the present invention relates to an electric liquid transporting machine. Further, the present invention relates specifically to the field of submersible electric machines especially configured and intended for treatment/transport applications, and comprises submersible electric machines such as submersible pumps and submersible mixers. It shall be pointed out that despite the name/term submersible pumps, it is a fact in the technical field in question that submersible pumps can be located in the pumped liquid, i.e. wet-installed applications, or alternatively be located separate from the pumped liquid, i.e. dry-installed applications. Thus, the term submersible does not specify that the device is or must be submersed, but defines that the device has specific properties/qualities.

The submersible electric machine comprises a hydraulic unit that comprises an impeller configured for propelling/moving the liquid, a drive unit that comprises a drive unit housing defining a motor compartment, an electric motor arranged in the motor compartment and drive shaft connected to the electric motor, the drive shaft extending from the electric motor to the hydraulic unit and being connected to the impeller, a top unit that comprises a top unit housing defining an electronics chamber, the electronics chamber being separated from the motor compartment by a dividing structural wall, and a vibration sensor.

BACKGROUND OF THE INVENTION

Submersible electric machines having an internal vibration sensor is known in the art, see for instance KR101578478 and EP2426360. '478 disclosing a submersible pump having an unspecified vibration sensor connected to an upper surface of a terminal board that separates an electronics chamber from the motor compartment that houses the electric motor. '360 discloses a submersible pump having a 1D or 2D vibration sensor connected to an upper bearing housing that separates an electronics chamber from the motor compartment that houses the electric motor. The 2D vibration sensor monitors two dimensions perpendicular to the drive shaft of the pump.

The main object of using an internal vibration sensor in submersible electric machines is as a protective feature, i.e. to monitor the condition/status of the submersible electric machine. A submersible electric machine is subject to vibrations during operation, mainly due to the rotating impeller, and elevated vibrations can be directly harmful and/or implies that the operation is not optimal. Basically, vibrations entails that mechanical parts of the submersible electric machine wear faster and thereby has a shorter life. The vibration sensor is used to detect abnormal condition.

Common conditions and circumstances, that can lead to elevated vibration and that are of interest to warn and protect against, are clogging, bad attachment of the pump, piping systems that are mechanically weak or badly attached, damaged parts such as impeller and drive shaft, severely defected bearings, etc.

Heavy duty submersible electric machines, for instance submersible pumps having a rated power in the range from about 48 kW (about 60 Horsepower) to about 800 kW (about 1100 Horsepower) or more, are really expensive and also hard to exchange. Pumps in the upper end of the interval can easily by 2-4 meters high and have a weight of several tons. Thus, the vibration sensor shall be configured to detect if the pump is vibrating more than normally and in such cases initiate a warning signal or a total stop of the pump in order to be able to service the pump before it is damaged, i.e. the submersible electric machine shall be configured to take precautionary measures based on the monitoring of the vibration.

However, it has become apparent that in almost all applications the detrimental and unfavorable vibration component has not been collinear with the measuring direction of the vibration sensor. It has also been unknown which frequencies that are the most unfavorable, and thereby the essential measuring range, in order to provide accurate protection of the submersible electric machine. Resulting in that known arrangements use too large safety margins and thereby too many false warnings and unnecessary stops are initiated.

OBJECT OF THE INVENTION

The present invention aims at obviating the aforementioned disadvantages and failings of previously known submersible electric machines, and at providing an improved submersible electric machine. A primary object of the present invention is to provide an improved submersible electric machine of the initially defined type that comprises a vibration sensor configured to monitor the whole range of harmful frequencies. It is another object of the present invention to provide a submersible electric machine, wherein the attachment structure for the vibration sensor is designed not to interfere with the vibration monitoring in the essential measuring range.

SUMMARY OF THE INVENTION

According to the invention at least the primary object is attained by means of the initially defined submersible electric machine having the features defined in the independent claim. Preferred embodiments of the present invention are further defined in the dependent claims.

According to the present invention, there is provided a submersible electric machine of the initially defined type, which is characterized in that the vibration sensor is directly or indirectly connected to a partition arranged in the electronics chamber, is configured to monitor vibrations in at least two dimensions [2D] and is configured to monitor vibrations at frequencies ranging up to 500 Hz, and in that the partition is made of metal, is connected to the top unit housing and has a natural frequency equal to or more than 500 Hz.

Thus, the present invention is based on the insight of using a vibration sensor configured to monitor a wide range of frequencies, i.e. the essential measuring range, and an attachment structure for the vibration sensor designed to have a natural frequency above the essential measuring range. Thereby, the monitoring of the vibrations of the submersible electric machine that is implemented entails correct and reliable precautionary measures. Thereby the service can be made more efficient and the productive life of the submersible electric machine will increase.

According to a second aspect of the present invention, there is provided a system that comprises at least one submersible electric machine assembly that comprises a submersible electric machine of the above type and a base unit, the base unit being operatively connected to the vibration sensor of the submersible electric machine and being configured to break/close the current to the submersible electric machine, a central unit operatively connected to the base unit of each of the at least one submersible electric machine assembly, and an operator interface operatively connected to the central unit.

According to a preferred embodiment of the present invention, the partition is made of aluminum. Thereby obtaining a rigid partition and at the same time obtaining a low weight partition.

According to a preferred embodiment of the present invention, the partition is arranged to divide the electronics chamber into a high voltage section and a low voltage section, the terminal block of the being arranged in the high voltage section and the vibration sensor being arranged in the low voltage section. Thereby, the vibration sensor is shielded from interference from the terminal block.

According to a preferred embodiment of the present invention, the vibration sensor is configured to monitor vibrations in three dimensions [3D].

According to a preferred embodiment of the present invention, the top unit comprises an electronic module configured for monitoring the operation of the submersible electric machine, the electronic module being attached to the partition, and wherein the vibration sensor is integrated into the electronic module.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

The present invention relates generally to the field of submersible electric machines especially configured for handling and/or transporting liquid, preferably liquid comprising solid matter. The submersible electric machine is for instance constituted by a submersible pump or a submersible mixer. The present invention relates specifically to the field of submersible pumps such as centrifugal pumps and axial/propeller pumps. The present invention will be described in connection with a pump application, but it shall be realized that this also applies to mixer applications if nothing else is indicated. The present invention will be described in connection with a wet-installed pump, but it shall be realized that this also applies to dry-installed pumps if nothing else is indicated. A wet-installed application entails that the device is partly or fully submersed in the liquid. A dry-installed application entails that the device is fully located separated from the liquid.

Figure 1:
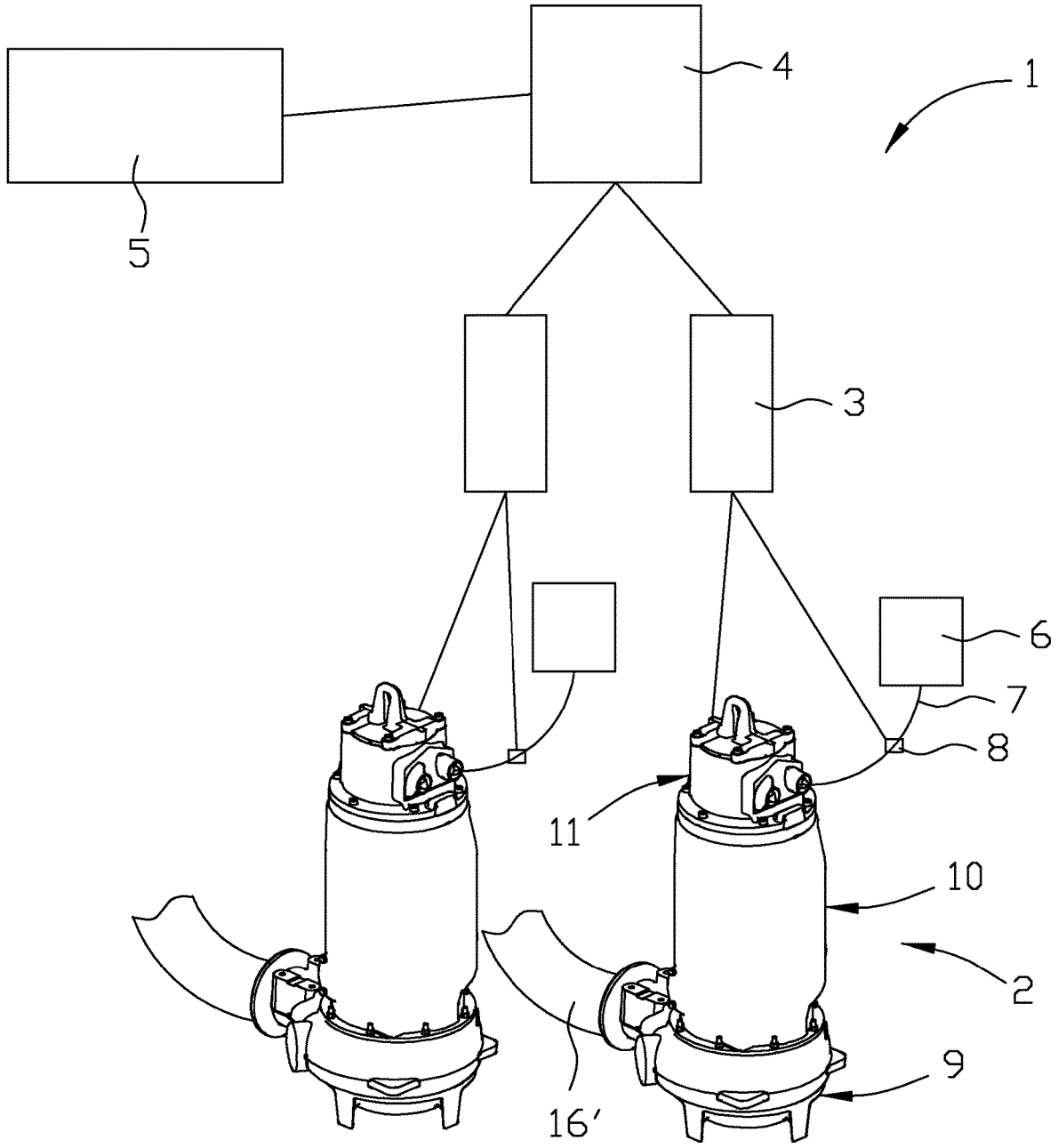
FIG. 1 is a schematic illustration of an inventive system for transporting a liquid.

Reference is initially made to FIG. 1, schematically disclosing an inventive system for transporting a liquid, generally designated 1. The system 1 comprises at least one submersible electric machine assembly that comprises a submersible electric machine, generally designated 2 and a base unit 3. The system 1 disclosed in FIG. 1 comprises two submersible electric machine assemblies, i.e. two submersible electric machines 2 and two base units 3. One specific base unit 3 is operatively connected to one submersible electric machine 2, and the base unit 3 is configured to break/close the current to the submersible electric machine 2. Thus, the base unit 3 is configured to control the operation of the submersible electric machine 2. The system 1 also comprises a central unit 4 operatively connected to the base unit 3 of each of the at least one submersible electric machine assembly, and an operator interface 5 operatively connected to the central unit 4.

The central unit 4 comprises an embedded web page, configured to disclose data concerning different operational parameters of all the submersible electric machines 2. Thus, the central unit 4 collects data and communicates with all connected submersible electric machine assemblies and provides all data to the operator interface in order to provide an overall view of the entire system to the operator.

According to one embodiment the operator interface 5 is constituted by an operator panel connected to the central unit 4 via a data cable, wherein the operator panel is configured to interact with the embedded web page. The operator panel is located in close vicinity of the central unit 4. According to an alternative and/or complementary embodiment the operator interface 5 is constituted by a remote operator device operatively connected to the central unit 4, either via a data cable or wirelessly via a wireless router connected to the central unit 4 via a data cable, wherein the remote operator device is configured to interact with the embedded web page. The remote operator device may be constituted by a smartphone, a laptop, a tablet, a PC, etc.

According to the preferred embodiment the submersible electric machine assembly comprises a Variable Frequency Drive (VFD) 6. The VFD 6 is connected to the submersible electric machine 2 via an electric power cable, generally designated 7. The base unit 3 is connected to a circuit breaker 8 that is arranged to break/close the power wires of the electric power cable 7.

Figure 2:
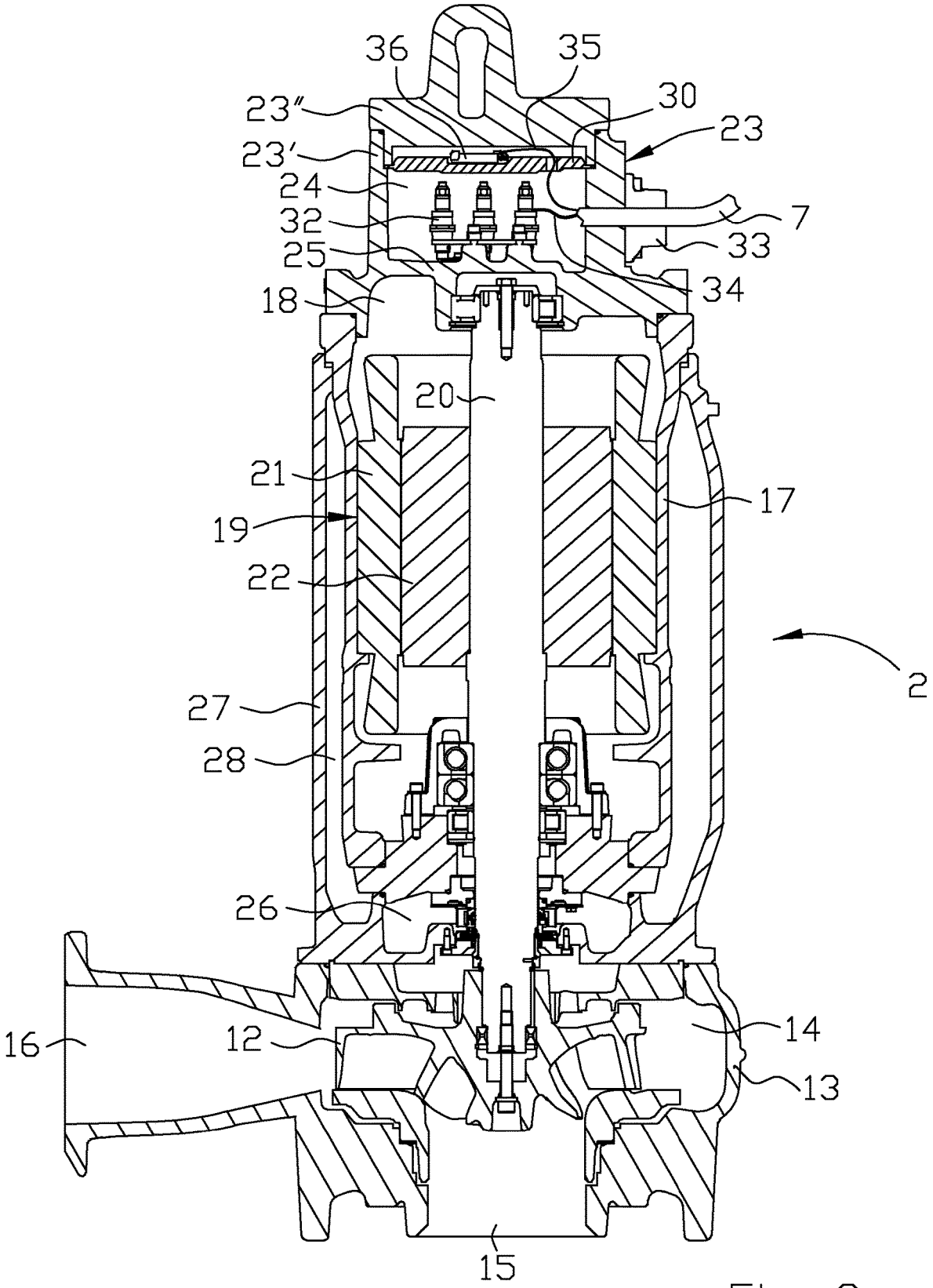
FIG. 2 is a schematic cross sectional view of an inventive submersible electric machine according to a preferred embodiment.
Figure 3:
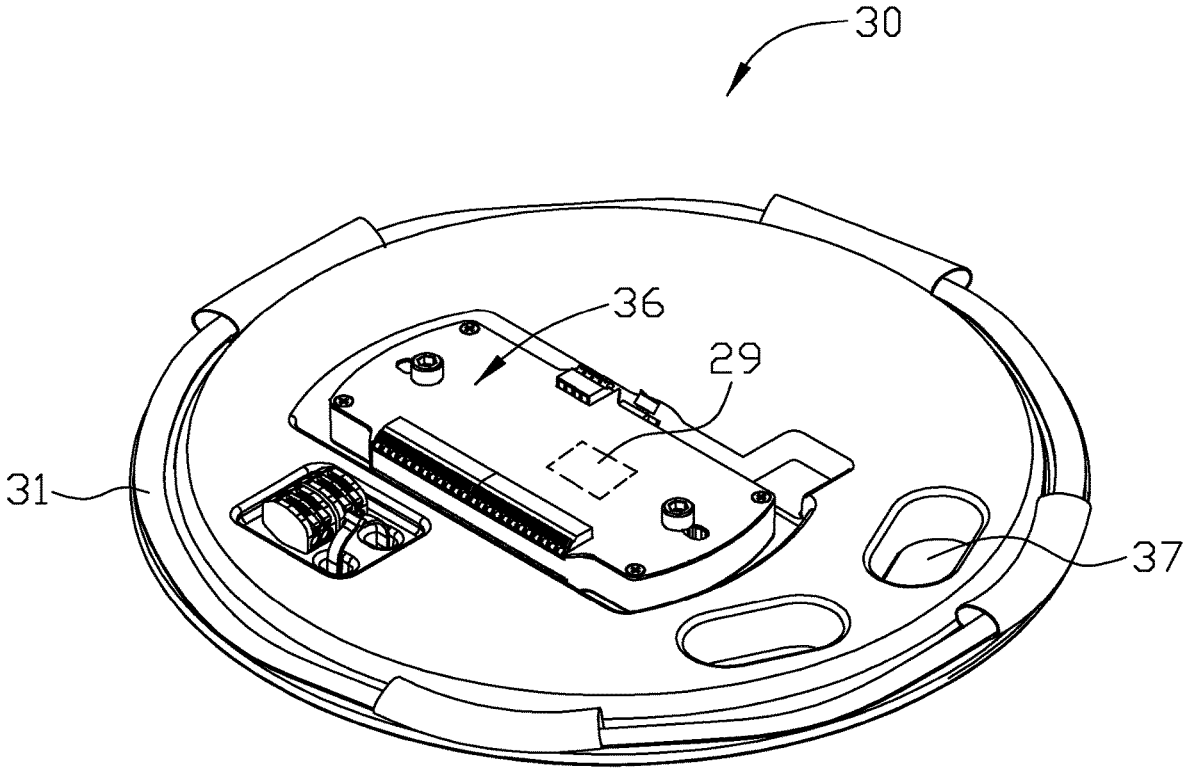
FIG. 3 is a schematic perspective view from above of a partition.

Reference is now also made to FIGS. 2 and 3. The submersible electric machine 2 comprises a hydraulic unit 9, a drive unit 10 and a top unit 11.

The hydraulic unit 9 comprises an impeller 12 configured for propelling the liquid. According to the disclosed embodiment, i.e. pump applications, the hydraulic unit 9 also comprises a volute 13 defining a pump chamber 14, the pump chamber 14 having an inlet opening 15 and an outlet opening 16. The impeller 12 is located in the pump chamber 14 and is configured to move liquid from the inlet opening 15 to the outlet opening 16 via the pump chamber 14, when the submersible electric machine 2 is in operation. An outlet conduit 16' is releasably connected to the outlet opening 16 of the pump. In dry-installed applications an inlet conduit is releasably connected to the inlet opening 15 of the pump, i.e. the inlet conduit extend from the basin that houses the liquid to be pumped to the inlet opening 15 of the pump.

The drive unit 10 comprises a drive unit housing 17 defining a motor compartment 18, an electric motor 19 arranged in the motor compartment 18 and a drive shaft 20 connected to the electric motor 19. The electric motor 19 comprises a stator 21 and a rotor 22, wherein the drive shaft 20 is connected to the rotor 22 of the electric motor 19. The drive shaft 20 extends from the electric motor 19 to the hydraulic unit 9, wherein the impeller 12 is connected to and driven in rotation by the drive shaft 20 during operation of the submersible electric machine 2. Thus, the submersible electric machine 2 is configured to be operated at a variable operational speed [rpm], by means of the VFD 6 that is configured to control the operational speed of the submersible electric machine 2. The operational speed of the submersible electric machine 2 is more precisely the rpm of the electrical motor 19 and of the impeller 12, and correspond/relate to a VFD 6 output frequency.

The top unit 11 comprises a top unit housing 23 defining an electronics chamber 24, also known as connection chamber. The liquid tight electronics chamber 24 is separated from the motor compartment 18 by a dividing structural wall 25. The top unit housing 23 is divided into a lower housing portion 23' and an upper housing portion 23".

The different housing parts of the submersible electric machine 2 and the impeller 12 are preferably made of metal, such as aluminum and/or iron/steel. According to the disclosed embodiment the pump chamber 14 is separated from the liquid tight motor compartment 18 by means of a liquid seal chamber 26, preventing the pumped liquid to reach the motor compartment 18 along the drive shaft 20. Thereto the submersible electric machine 2 according to the disclosed embodiment comprises an outer jacket 27 enclosing the drive unit housing 17. The outer jacket 27 is configured to define internal cooling arrangements 28 for cooling down the motor compartment 18 and the electric motor 19, especially useful in dry-installed application but also used in wet-installed applications.

The components of the submersible electric machine 2 are usually, directly or indirectly, cold down by means of the liquid/media surrounding the submersible electric machine 2. The submersible electric machine 2 is designed and configured to be able to operate in a submerged configuration/position, i.e. during operation be configured to be able to be located entirely under the liquid surface. However, it shall be realized that in wet-installed applications the submersible electric machine 2 during operation must not be entirely located under the liquid surface but may continuously or occasionally be partly located above the liquid surface. The submersible electric machine 2 is intended to be located in a natural recess/cavity/pit or in a prepared tank/station. In dry-installed applications the submersible electric machine 2 during operation is entirely located separated from/outside the pumped liquid.

It is essential that the submersible electric machine 2 comprises a vibration sensor 29, schematically illustrated in FIG. 3, and a partition 30 arranged in the electronics chamber 24. The vibration sensor 29 shall be directly or indirectly connected to the partition 30. The vibration sensor 29 is configured to monitor vibrations in at least two dimensions [2D] and is configured to monitor vibrations at frequencies ranging from 10 Hz up to 500 Hz. According to a preferred embodiment the vibration sensor 29 is configured to monitor vibrations in three dimensions [3D], in order to obtain a complete monitoring of vibrations in all possible directions independently of the orientation of the vibration sensor 29. The vibrations are measured in each dimension over the entire monitoring/measuring frequency range. Based on these data, a vibration speed mean value is determined, for instance using root-square-means, for each dimension. Thereafter a vibration speed resultant for all dimensions is determined/calculated, using root-square-means. The base unit 3 is operatively connected to the vibration sensor 29 of the submersible electric machine 2, and if the vibration speed resultant exceeds a predetermined threshold the base unit 3 will provide a warning signal or stop the submersible electric machine 2.

The partition 30 is made of metal and is connected to the top unit housing 23 such that the vibrations of the submersible electric machine 2 is transferred/propagates to the partition 30 and to the vibration sensor 29 at the same time as the partition 30 is rigid. Preferably, the partition 30 is made of aluminum in order to obtain a rigid construction and at the same time a low weight construction. According to a preferred embodiment, the partition 30 is arranged/clamped between the lower housing portion 23' and the upper housing portion 23" of the top unit housing 23. According to the preferred embodiment the partition 30 is clamped by means of a spring element 31, circular wave spring, towards the lower housing portion 23', i.e. the spring element 31 is located between the upper housing portion 23" and the partition 30.

It is essential that the partition 30 has a natural frequency equal to or more than 500 Hz, i.e. above the monitoring/measuring range of the vibration sensor 29 in order not to cause false vibration readings. Preferably, the natural frequency of the partition 30 is equal to or more than 700 Hz, in order to have a safety margin from the monitoring range of the vibration sensor 29.

The submersible electric machine 2 comprises a terminal block 32 arranged in the electronics chamber 24. The electric power cable 7 extends through a liquid tight lead-trough 33 into the electronics chamber 24, preferably through the lower housing portion 23' of the top unit housing 23. Heavy duty submersible electric machines 2 may comprise two or more parallel electric power cables in order to obtain enough cross section area of the power wires. A minimum distance between the terminal block 32 and the partition 30 is equal to or more than 7 millimeters, preferably equal to or more than 10 millimeters.

According to a preferred embodiment the surface of the partition 30 facing the terminal block 32 is coated with an insulating coating. The insulating coating has a dielectric strength equal to or more than 5 kV, preferably equal to or more than 8 kV. Measured at 20° C. and 65% Relative Humidity. The insulating coating has a thickness equal to or more than 0.2 millimeter, preferably equal to or more than 0.4 millimeter, and thereto equal to or less than 2 millimeters.

According to the disclosed embodiment the partition 30 is arranged to divide the electronics chamber 24 into a high voltage section and a low voltage section, wherein the high voltage section is configured for levels exceeding 400 VAC and up to 1500 VAC and the low voltage section is configured for levels up to 24 VDC, preferably up to 50 VDC. The terminal block 32 is arranged in the high voltage section and the vibration sensor 29 is arranged in the low voltage section. Thus, in the disclosed embodiment the insulating coating is coated onto the surface of the partition 30 facing the high voltage section. Preferably, the high voltage section of the electronics chamber 24 is located intermediate the motor compartment 18 and the low voltage section, in order to minimize the electromagnetic interference and heat from the electric motor to the low voltage section as much as possible.

The electric power cable 7 comprises a plurality of power wires 34 connected to the terminal block 32, and thereto the electric power wire 7 comprises a first pair of communication wires 35 operatively connected to the vibration sensor 29 and connected to the base unit 3. The first pair of communication wires 35 is configured for two-way data communication.

According to the preferred embodiment, the top unit 11 comprises an electronic module 36 configured for monitoring the operation of the submersible electric machine 2. The electronic module 36 is firmly attached to the partition 30. According to a preferred embodiment the vibration sensor 29 is integrated into the electronic module 36, wherein the vibration sensor is constituted by a MEMS vibration sensor. By having a mechatronic and integrated vibration sensor 29 it is possible to measure accurately, the vibration sensor takes small space and works in an environment with severe electromagnetic interference and high heat. Other sensors, such as motor temp sensors, bearing temp sensors, leakage sensors, etc. are also connected to the electronic module 36, wherein said first pair of communication wires 35 are connected to the electronic module 36. Thereby measuring signals (analog signals) from all sensors are collected and stored as digital data in a memory/storage device of the electronic module 36, said data being transferred between the submersible electric machine 2 and the base unit 3 via the first pair of communication wires 35. The memory of the electronic module 36 comprises predetermined thresholds, for sending alarm signals/information to the base unit 3 or to send stop signals to the base unit 3. The memory of the electronic module 36 may also store running statistics and thus act as a black box if the submersible electric machine 2 breaks down or is stopped. The memory may also comprise rating plate data of the submersible electric machine 2. Preferably all information on the memory of the electronic module 36 also has a copy on a memory/storage device of the central unit 4.

Preferably, the electric power cable 7 also comprises a second pair of communication wires (not shown) that is not connected to the electronic module 36 but directly to a temperature sensor (not disclosed). Thus, the temperature sensor is directly connected to the base unit 3 via the second pair of communication wires, when the temperature being too high the base unit 3 shall break the current to the submersible electric machine 2 as quickly as possible, without being processed in the electronic module 36. It is not necessary that the second pair of communication wires is configured for two-way communication.

The partition 30 comprises at least one passage 37 for passing through at least the first pair of communication wires 35 from the high voltage section to the low voltage section. The inner surface of the at least one passage 37 is preferably coated with the insulating coating.

The electronic module 36 may comprise an integrated current transformer (not disclosed) configured for measuring the submersible electric machine 2 current and preferably configured for measuring the frequency of the submersible electric machine voltage supply. Data from the current transformer can be used to at least determine running time and number of starts. This is useful when the submersible electric machine is leased, and in order to plan for next service.

The system may also comprise a power analyzer (not disclosed) operatively connected to the base unit 3, in order to monitor/measure current, voltage, power, power factor, and imbalances between the phases. Such data can give valuable information to the operator in order to prevent breakdown.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A submersible electric machine for transporting a pumped liquid, the submersible electric machine comprising:

a hydraulic unit comprising an impeller configured to propel the liquid;

a drive unit comprising:

a drive unit housing defining a liquid-tight motor compartment separated from the pumped liquid, an electric motor arranged in the motor compartment, a drive shaft connected to the electric motor, extending from the electric motor to the hydraulic unit, and connected to the impeller;

a top unit comprising:

a top unit housing defining an electronics chamber with a dividing structural wall, the dividing structural wall fluidly separating the electronics chamber from the motor compartment;

a metal partition, arranged in the electronics chamber and connected to the top unit housing, having a natural frequency equal to or more than 500 Hz, the metal partition arranged to divide the electronics chamber into a high voltage section and a low voltage section, the high voltage section housing the terminal block and located intermediate the motor compartment and the low voltage section; and a vibration sensor located in the low voltage section and directly or indirectly connected to the metal partition, the vibration sensor configured to monitor vibrations in at least two dimensions and at frequencies ranging up to 500 Hz.

2. The submersible electric machine of claim 1, wherein the natural frequency of the metal partition is equal to or more than 700 Hz.

3. The submersible electric machine of claim 1, wherein the metal partition comprises aluminum.

4. The submersible electric machine of claim 1, wherein a minimum distance between the terminal block and the metal partition is equal to or more than 7 millimeters.

5. The submersible electric machine of claim 4, wherein the minimum distance between the terminal block and the metal partition is equal to or more than 10 millimeters.

6. The submersible electric machine of claim 4, wherein the metal partition has a first surface facing the terminal block, the first surface having an insulating coating.

7. The submersible electric machine of claim 6, wherein the insulating coating has a thickness equal to or more than 0.2 millimeters.

8. The submersible electric machine of claim 7, wherein the insulating coating has a thickness equal to or more than 0.4 millimeters.

9. The submersible electric machine of claim 4, wherein the submersible electric machine has an electric power cable with power wires connected to the terminal block.

10. The submersible electric machine of claim 9, wherein the electric power cable further comprises a first pair of communication wires operatively connected to the vibration sensor and to a base unit.

11. The submersible electric machine of claim 1, wherein:

the top unit comprises an electronic module configured for monitoring the operation of the submersible electric machine;

the electronic module is attached to the metal partition; and the vibration sensor is integrated into the electronic module.

12. The submersible electric machine of claim 1, wherein the vibration sensor is configured to monitor vibrations in three dimensions.

13. The submersible electric machine of claim 1, wherein:

the submersible electric machine comprises a submersible pump;

the hydraulic unit comprises a volute defining a pump chamber, the pump chamber having an inlet opening and an outlet opening; and the impeller is located in the pump chamber.

14. The submersible electric machine of claim 13, wherein the pump chamber is separated from the motor compartment by a liquid seal chamber.

15. A system for transporting a pumped liquid, comprising:

at least one submersible electric machine assembly comprising:

the submersible electric machine of claim 1, and a base unit operatively connected to the vibration sensor of the submersible electric machine, the base unit configured to break or close the current to the submersible electric machine;

a central unit operatively connected to the base unit of each of the at least one submersible electric machine assembly; and an operator interface operatively connected to the central unit.

16. The system of claim 15, wherein:

the central unit comprises an embedded interactive interface accessible via a communications network, the embedded interactive interface configured to disclose operational parameter data of the at least one submersible electric machine connected thereto;

the operator interface comprises:

(a) an operator panel connected to the central unit via a data cable, (b) a remote operator device operatively connected to a wireless router, or (c) a combination of (a) and (b), connected to the central unit via a data cable; and the operator panel, the remote operator device, or the combination thereof is configured to interact with the embedded interface.

17. The system of claim 15, wherein:

the submersible electric machine assembly comprises a Variable Frequency Drive connected to the submersible electric machine via an electric power cable; and the base unit is connected to a circuit breaker arranged to break or close power wires of the electric power cable.

18. The system of claim 16, wherein the embedded interactive interface comprises a web page.

19. A submersible electric machine for transporting a pumped liquid, the submersible electric machine comprising:

a hydraulic unit comprising an impeller configured to propel the liquid;

a drive unit comprising:

a drive unit housing defining a liquid-tight motor compartment separated from the pumped liquid, an electric motor arranged in the motor compartment, a drive shaft connected to the electric motor, extending from the electric motor to the hydraulic unit, and connected to the impeller;

a top unit comprising:

a top unit housing defining an electronics chamber with a dividing structural wall, the dividing structural wall separating the electronics chamber from the motor compartment;

a metal partition, arranged in the electronics chamber and connected to the top unit housing, having a natural frequency equal to or more than 500 Hz, the metal partition arranged to divide the electronics chamber into a high voltage section and a low voltage section, the high voltage section housing the terminal block and located intermediate the motor compartment and the low voltage section; and a vibration sensor mounted in the low voltage section and directly or indirectly connected to the metal partition, the vibration sensor configured to monitor vibrations transmitted through the metal partition in at least two dimensions and at frequencies ranging up to 500 Hz.

* * * * *